US005578148A

United States Patent [19]

Eylon et al.

[11] Patent Number: 5,578,148

[45] Date of Patent: Nov. 26, 1996

[54] METHOD TO PRODUCE HIGH TEMPERATURE OXIDATION RESISTANT METAL MATRIX COMPOSITES BY FIBER DIAMETER GRADING

[75] Inventors: Daniel Eylon, Dayton; Stephen W. Schwenker, Kettering, both of Ohio

[73] Assignee: The United States of America as represented by the Secretary of the Air Force, Washington, D.C.

[21] Appl. No.: 506,226

[22] Filed: Jul. 24, 1995

[51] Int. Cl.[6] ..... B23K 31/02

[52] U.S. Cl. ..... 148/527; 148/537; 228/122.1; 228/190

[58] Field of Search ..... 228/122.1, 190, 228/193; 148/516, 527, 535, 537, 421; 428/614

[56] References Cited

U.S. PATENT DOCUMENTS

| | | | |
|---|---|---|---|
| 4,733,816 | 3/1988 | Eylon et al. | 228/190 |
| 4,746,374 | 5/1988 | Froes et al. | 228/190 |
| 4,822,432 | 4/1989 | Eylon et al. | 148/127 |
| 4,919,594 | 4/1990 | Wright et al. | 416/230 |
| 5,104,460 | 4/1992 | Smith et al. | 148/527 |
| 5,118,025 | 6/1992 | Smith et al. | 228/190 |

*Primary Examiner*—George Wyszomierski
*Attorney, Agent, or Firm*—Charles E. Bricker; Thomas L. Kundert

[57] ABSTRACT

A method to produce high temperature oxidation resistant metal matrix composites by fiber diameter grading which comprises the steps of (a) laying up an alloy/fiber preform consisting of a plurality of alternating layers of metal alloy and fibers and (b) consolidating the preform under suitable conditions, wherein fibers of at least two diameters are employed and wherein the layers of fibers in the preform are graduated so that larger diameter fibers are located nearer what will become the exposed surface of the composite and smaller diameter fibers are located toward the interior of the composite.

8 Claims, 1 Drawing Sheet

METHOD TO PRODUCE HIGH TEMPERATURE OXIDATION RESISTANT METAL MATRIX COMPOSITES BY FIBER DIAMETER GRADING

RIGHTS OF THE GOVERNMENT

The invention described herein may be manufactured and used by or for the Government of the United States for all governmental purposes without the payment of any royalty.

BACKGROUND OF THE INVENTION

This invention relates to titanium alloy/fiber composite materials. In particular, this invention relates to a method to produce high temperature oxidation resistant composite materials.

Composites are recognized as a material class capable of operating under conditions requiring very high specific stiffness and strength. Synthetic matrix composites are generally limited to maximum operating temperatures of about 200° C. Metal matrix composites are capable of higher operating temperatures. Aluminum- and titanium-based composites comprise the majority of metal matrix composites employed, particularly in aerospace applications.

Titanium composites are fabricated by several methods, including superplastic forming/diffusion bonding of a sandwich consisting of alternating layers of metal and fibers by vacuum hot pressing, hot isostatic pressing, and the like. At least four high strength/high stiffness filaments or fibers for reinforcing titanium alloys are commercially available: silicon carbide, silicon carbide-coated boron, boron carbide-coated boron and silicon-coated silicon carbide. Under superplastic conditions, the titanium matrix material can be made to flow without fracture occurring, thus providing intimate contact between layers of the matrix material and the fiber. The thus—contacting layers of matrix material bond together by a phenomenon known as diffusion bonding. Unfortunately, at the same time a reaction occurs at the fiber-matrix interfaces, giving rise to what is called a reaction zone. The intermetallic compounds formed in the reaction zone may include reaction products like TiSi, $Ti_5Si$, TiC, TiB and $TiB_2$. The thickness of this brittle reaction zone is a diffusion controlled reaction and thus increases with increasing time and with increasing temperature of bonding. Such brittle reaction zones introduce sites for easy crack initiation and propagation within the composite, which can operate in addition to existing sites introduced by the original distribution of defects in the filaments and/or the matrix.

Aluminum-based composites are currently limited in application to about 800° F., due to their degraded matrix strength at higher temperatures. Titanium- and nickel-based metal matrix composites are currently considered for many advanced aerospace applications such as airframes and high compression gas turbine engines at temperatures as high as 1600° F. (870° C.).

Research on the effects of prolonged high temperature exposure to air or an oxidizing environment has shown that metal matrix composites may suffer severe loss of strength, fatigue and creep resistance due to oxygen diffusion from the component surface into the fiber/matrix reaction zones nearest the surface. The reaction zone can, to some extent, be controlled by providing the fibers with a barrier coating, incorporating reaction zone reducing elements into the matrix, control of fabrication conditions, or the like. Oxygen diffusion into the composite can embrittle the reaction zone and/or damage the fiber, leading to early fiber fracture by tensile, creep, impact or fatigue loading.

The stiffness ($E_c$) and tensile strength ($\sigma_c$) of metal matrix composites are calculated using the rule-of-mixtures (ROM) formulae:

| | |
|---|---|
| Stiffness ($E_c$): | $E_c = E_f(V_f) + E_m(1 - V_f)$ |
| Longitudinal Tensile Strength ($\sigma_c$): | $\sigma_c = \sigma_f(V_f) + \sigma_m'(1 - V_f)$ |

where $E_f$ is the fiber modulus, $E_m$ is the matrix modulus, $V_f$ is the fiber volume, $\sigma_f$ is the fiber tensile strength and $\sigma_m'$ is the matrix stress when the fibers are at their ultimate tensile strain. Thus, oxygen diffusion into the composite can reduce the effective volume fraction of fibers by destroying the fibers and/or by embrittling the interface between the matrix and fiber. According to the above formulae, the composite stiffness and tensile strength are correspondingly reduced.

Accordingly, it is an object of this invention to provide a method to produce improved high temperature oxidation resistant titanium alloy matrix composites.

Other objects and advantages of the invention will be apparent to those skilled in the art.

SUMMARY OF THE INVENTION

In accordance with the present invention, there is provided a method to produce high temperature oxidation resistant metal matrix composites by fiber diameter grading. The method of this invention comprises the steps of (a) laying up an alloy/fiber preform consisting of a plurality of alternating layers of metal alloy and fibers and (b) consolidating the preform under suitable conditions, wherein fibers of at least two diameters are employed and wherein the layers of fibers in the preform are graduated so that larger diameter fibers are located nearer what will become the exposed surface of the composite and smaller diameter fibers are located toward the interior of the composite.

DETAILED DESCRIPTION OF THE INVENTION

Figure 1:
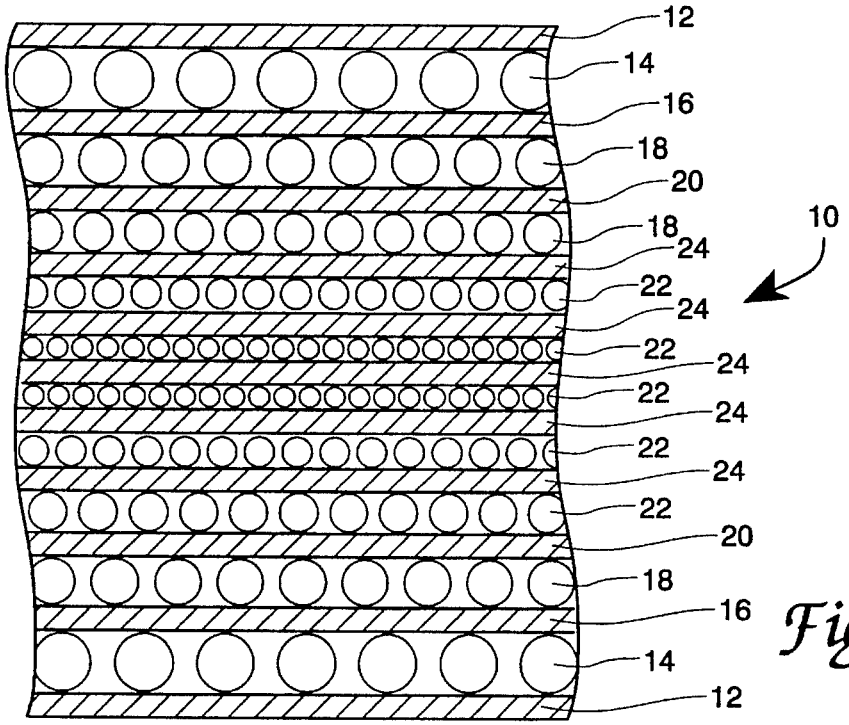
FIG. 1 illustrates fabrication of a metal/fiber sandwich.

The method of this invention may be employed to fabricate metal matrix composites using any titanium alloy, including alpha+beta, near-alpha and beta titanium alloys, as well as the ordered titanium-aluminum intermetallic compounds, $Ti_3Al$ and TiAl, including alpha-2, orthorhombic and gamma titanium aluminides.

Typical alpha+beta, beta and near-alpha titanium alloys include the following (all amounts in weight percent): Ti-6Al-4V, Ti-6Al-6V-2Sn, Ti-8Mn, Ti-7Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-4Zr-2Mo-2Cr, Ti-6Al-2Sn-2Zr-2Mo-2Cr, Ti-3Al-2.5V, Ti-5Al-2.5Sn, Ti-8Al-1Mo-1V, Ti-6Al-2Sn-4Zr-2Mo-0.1Si, Ti-6Al-2Nb-1Ta-0.8Mo, Ti-2.25Al-11Sn-5Zr-1Mo, Ti-5.5Al-3.5Sn-3Zr-0.3Mo-1Nb-0.3Si, Ti-5.5Al-4Sn-4Zr-0.3Mo-1Nb-0.5Si-0.06C, Ti-30Mo, Ti-13V-11Cr-3Al, Ti-3Al-3V-6Cr-4Mo-4Zr, Ti-15V, Ti-11.5Mo-6Zr-4.5Sn, Ti-10Mo, Ti-6.3Cr, Ti-15V-3Cr-3Al-3Sn and Ti-10V-

2Fe-3Al. These alloys may further contain up to about 6 weight percent of a dispersoid such as boron, thorium or rare earth elements.

Typical ordered titanium-aluminum intermetallic alloys include the following (all amounts in weight percent):Ti-16Al, Ti-15.8Al, Ti-14Al-22Nb, Ti-14.3Al-19.7Nb, Ti-15Al-10.3Nb, Ti-15.4Al-5.3Nb, Ti-14Al-25Nb, Ti-14Al-20Nb-3V-2Mo, Ti-14.6Al-10Nb-4W, Ti-13Al-31Nb, Ti-11Al-39Nb, Ti-13Al-40Nb, Ti-36Al, Ti-31Al-2.5Cr-2.5Nb and Ti-31.5Al.

As stated previously, the composites are fabricated by superplastic forming/diffusion bonding of a sandwich consisting of alternating layers of metal and fibers. At least four high strength/high stiffness filaments or fibers for reinforcing titanium alloys are commercially available: silicon carbide, silicon carbide-coated boron, boron carbide-coated boron and silicon-coated silicon carbide. Under superplastic conditions, the titanium alloy matrix material can be made to flow without fracture occurring, thus providing intimate contact between layers of the matrix material and the fiber. The thus-contacting layers of matrix material bond together by a phenomenon known as diffusion bonding. Unfortunately, at the same time a reaction occurs at the fiber-matrix interfaces, giving rise to what is called a reaction zone. The intermetallic compounds formed in the reaction zone may include reaction products like TiSi, $Ti_5Si$, TiC, TiB and $TiB_2$. The thickness of this brittle reaction zone is a diffusion controlled reaction and thus increases with increasing time and with increasing temperature of bonding. Such brittle reaction zones introduce sites for easy crack initiation and propagation within the composite, which can operate in addition to existing sites introduced by the original distribution of defects in the filaments and/or the matrix.

The metal layers for fabricating the above-described sandwich are rolled foil having a thickness of 3 to 10 mils, or preferably, rapidly solidified foil having a thickness of about 10 to 100 microns. The layers may also be produced by powder techniques, such as plasma spray, tape casting or powder cloth.

Consolidation of the filament/metal layer preform sandwich is accomplished under suitable consolidating conditions, generally by application of heat and pressure over a period of time during which the matrix material is superplastically formed around the filaments to completely embed the filaments. Consolidation is carried out at a temperature in the approximate range of 50° to 300° C. (90° to 540° F.) below the beta-transus temperature of the titanium alloy. For example, the consolidation of a composite comprising Ti-6Al-4V alloy, which has a beta transus of about 995° C. (1825° F.) is preferably carried out at about 900° to 925° C. (1650° to 1700° F.). The pressure required for consolidation of the composite ranges from about 66 to about 200 MPa (about 10 to 30 Ksi) and the time for consolidation can range from about 15 minutes to 24 hours or more, depending upon the dimensions of the composite. Generally, consolidation time is about 2 to 4 hours.

The phrase "suitable consolidating conditions" is intended to mean heating the alloy-fiber preform to a temperature below the beta-transus temperature ($T_b$) of the alloy while applying a pressure of at least 10 Ksi for a time sufficient to effect consolidation. In the case of conventional alloys, the term "beta-transus" refers to the temperature at the line on the phase diagram for the alloy separating the β-phase field from the α+β region where the α and β phases coexist.

In the case of alpha-2 alloys, the term "beta-transus" refers to the temperature at the line on the phase diagram for the alloy separating the β-phase field from the $\alpha_2$+β region where the $\alpha_2$ and β phases coexist. In the case of orthorhombic alloys, the term "beta-transus" refers to the temperature at the line on the phase diagram for the alloy separating the β-phase field from the region where the β and o phases, and possibly the $\alpha_2$ phase, coexist.

Referring now to FIG. 1 of the drawing, a composite preform, indicated generally by the numeral 10, is fabricated by laying up alternating layers of metal and fibers. First, a layer of metal 12, which will become one of the exposed surfaces of the consolidated composite, is laid down. Atop the metal layer 12 is placed a layer of fibers 14, followed by another metal layer 16. For convenience, only a single fiber 14/metal 16 unit is shown; however, it is within the scope of the invention to incorporate multiple fiber 14/metal 16 units into the composite. Atop metal layer 16 is placed a layer of fibers 18, which fibers have a smaller diameter than the fibers 14. This fiber layer is followed by another metal layer 20. For convenience, two fiber 18/metal 20 units are shown; however, it is within the scope of the invention to incorporate more than two fiber 18/metal 20 units into the composite. Atop metal layer 20 is placed a layer of fibers 22, which fibers have a smaller diameter than the fibers 18. This fiber layer is followed by another metal layer 24. For convenience, four fiber 22/metal 24 units are shown; however, it is within the scope of the invention to incorporate more than four fiber 22/metal 24 units into the composite. The final metal layer 24 is followed by two fiber 18/metal 20 units which, in turn, are followed by one layer of fibers 14 and an outside layer of metal 12.

High strength/high stiffness filaments or fibers are commercially available from, for example, British Petroleum PLC, Farnborough, Hampshire, UK, Americom Inc., Chatsworth, Calif., and Textron Specialty Materials Division, Lowell, Mass., each such supplier generally offering only one filament diameter.

For ease of handling, it is desirable to introduce the filaments or fibers into the article in the form of a sheet or mat. Such a sheet may be fabricated by laying out a plurality of filaments in parallel relation upon a suitable surface and wetting the filaments with a fugitive thermoplastic binder, such as polystyrene. After the binder has solidified, the filamentary material can be handled as one would handle any sheet-like material. Alternatively, plasma spray deposition can be used to deposit a layer of titanium alloy directly on the filaments or fibers, thus providing a sheet-like material which is free of foreign materials, such as the aforementioned thermoplastic binder. Plasma spray deposition has the added advantage that the filaments or fibers are better wetted than they may be during consolidation.

Figure 2:
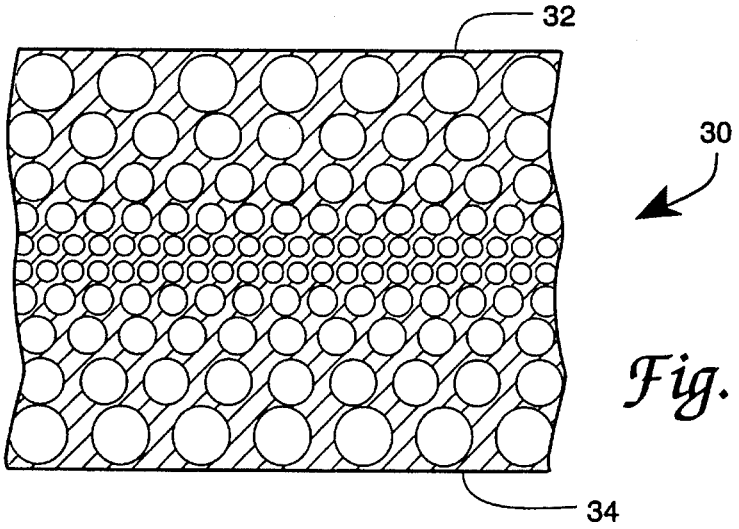
FIG. 2 illustrates a consolidated metal matrix composite in accordance with the invention.

The preform 10 is consolidated by superplastic forming/diffusion bonding, as previously discussed. If a fugitive binder is used with the reinforcing material, such binder must be removed prior to consolidation of the segments, without pyrolysis occurring. By using an apparatus equipped with heatable dies and a vacuum chamber surrounding at least the dies, removal of the binder and consolidation may be accomplished without having to relocate the preform from one piece of equipment to another. The resulting consolidated composite is shown in FIG. 2, indicated generally by the numeral 30. Composite 30 has two surfaces, 32 and 34, which may be exposed to high temperature, oxidizing conditions.

Figure 3:
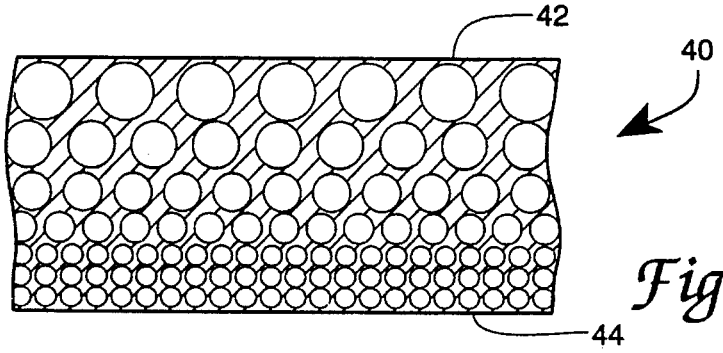
FIG. 3 illustrates an alternative embodiment of the invention.

FIG. 3 illustrates an alternative embodiment in which a composite 40 has only one surface 42 which may be exposed to high temperature, oxidizing conditions. The opposite surface 44 is otherwise protected, as by being part of an enclosed structure.

It will be appreciated by those skilled in the art that there is a minimum spacing-apart requirement for the fibers in the metal matrix composite in order that the matrix metal can form around and completely enclose the fibers. Such spacing apart may, for example, be about ¼ to ¾ times the fiber diameter, thus providing a fiber volume of about 50% to 25%, respectively. In a presently preferred embodiment, the fiber volume in layers 22 is about 25 to 40%.

The advantage of metal matrix composites fabricated according to the method of this invention is that the chance of reaction zone degradation is reduced in the near-surface fibers. Because the larger diameter fibers have less surface to volume ratio than smaller diameter fibers, they are less susceptible to oxidation attack. Smaller diameter fibers, on the other hand, allow high fiber densities, but are more susceptible to the adverse effect of oxygen. Overall high fiber density to satisfy the required strength and stiffness predicted by the rule of mixtures (ROM) can be maintained by employing a higher fiber density at the interior of the composite, i.e., the smaller diameter fibers will compact to a higher density, therefore compensating for the lower density of larger fibers nearer the surface(s).

Various modifications may be made in the instant invention without departing from the spirit and scope of the appended claims.

We claim:

1. A method to produce high temperature oxidation resistant metal matrix composites which comprises the steps of (a) laying up an alloy/fiber preform consisting of a plurality of alternating layers of metal alloy and fibers and (b) heating the preform to a temperature below the beta-transus temperature of the alloy while applying a pressure sufficient to effect consolidation of the preform, thereby producing a metal matrix composite consolidations; wherein fibers of at least two diameters are employed and wherein the layers of fibers in the preform are graduated so that larger diameter fibers are located nearer the surface of the composite and smaller diameter fibers are located toward the interior of the composite.

2. The method of claim 1 wherein said alloy is a titanium alloy.

3. The method of claim 1 wherein fibers of three diameters are employed.

4. The method of claim 1 wherein fiber density at the interior of the composite is higher than nearer the surface.

5. A method to produce high temperature oxidation resistant metal matrix composites which comprises the steps of (a) laying up an alloy/fiber preform consisting of a plurality of layers of metal alloy and fibers and (b) heating the preform to a temperature below the beta-transus temperature of the alloy while applying a pressure sufficient to effect consolidation of the preform, thereby producing a metal matrix composite consolidations; wherein fibers of at least two diameters are employed; and wherein the layers of fibers in the preform are graduated so that larger diameter fibers are located nearer the surface of the composite and smaller diameter fibers are located toward the interior of the composite; and wherein said layers of metal alloy and fibers are fabricated by depositing a layer of metal alloy on a plurality of fibers laid in parallel relation to provide a sheet-like material.

6. The method of claim 5 wherein said alloy is a titanium alloy.

7. The method of claim 5 wherein fibers of three diameters are employed.

8. The method of claim 5 wherein fiber density at the interior of the composite is higher than nearer the surface.

* * * * *